United States Patent [19]

Stecker et al.

[11] Patent Number: 4,502,617

[45] Date of Patent: Mar. 5, 1985

[54] FLAVOR DECANTER AND PUMP

[75] Inventors: Earl M. Stecker, Kiel; Richard C. Plamann, Appleton, both of Wis.

[73] Assignee: Stoelting, Inc., Kiel, Wis.

[21] Appl. No.: 462,160

[22] Filed: Jan. 31, 1983

[51] Int. Cl.[3] ..... B67D 5/40

[52] U.S. Cl. ..... 222/385; 222/185; 222/341; 417/454

[58] Field of Search ..... 222/180, 181, 185, 340, 222/341, 372, 382, 383, 385, 380, 384, 464, 79; 417/454, 559

[56] References Cited

U.S. PATENT DOCUMENTS

| | | | |
|---|---|---|---|
| 1,698,632 | 1/1929 | Jaden | 222/385 |
| 1,865,990 | 7/1932 | Wilcox | 222/385 X |
| 2,055,045 | 9/1936 | Paull | 222/382 |
| 2,205,875 | 6/1940 | Coffey et al. | 222/385 X |
| 2,545,988 | 3/1951 | Bobrick | 222/385 X |
| 2,622,539 | 12/1952 | Martin | 222/383 X |
| 2,678,753 | 5/1954 | Hersey | 222/385 X |
| 2,732,159 | 1/1956 | Connors et al. | 222/180 X |
| 2,746,644 | 5/1956 | Steiner | 222/79 |
| 2,765,964 | 10/1956 | Hanlon | 222/340 |
| 2,948,238 | 8/1960 | Hoffman | 222/385 X |
| 3,452,901 | 7/1969 | Roach | 222/385 X |
| 4,105,146 | 8/1978 | Broillard | 222/383 |

*Primary Examiner*—Joseph J. Rolla
*Assistant Examiner*—Kevin P. Shaver
*Attorney, Agent, or Firm*—Fuller, House & Hohenfeldt

[57] ABSTRACT

A decanter and sanitary pump assembly for dispensing metered quantities of liquid. The pump assembly is mounted inside the decanter, and the entire apparatus is quickly and easily disassembled for cleaning, thus making it particularly useful for dispensing food products. The outlet of the pump assembly projects downwardly from an overhanging section of the decanter to allow convenient placing of a liquid receiving container beneath the outlet.

10 Claims, 2 Drawing Figures

FLAVOR DECANTER AND PUMP

BACKGROUND OF THE INVENTION

1. Field of the Invention

This invention pertains to apparatus for dispensing liquids, and more particularly to an easily cleanable apparatus for dispensing predetermined quantities of liquids.

2. Description of the Prior Art

Apparatus for dispensing liquid and semi-liquid materials are well known. U.S. Pat. Nos. 1,865,990 and 2,678,753 are representative of pumps in which check valves are employed to properly direct the flow of the liquids from the reservoirs to the fluid outlets. The pump mechanisms employ a single housing which contains both the check valves and the piston assemblies utilized to produce the pumping action. In each disclosed apparatus, the liquid is ejected through a spout formed in the pump housing. It will be noticed that the pumping mechanisms are immersed within the liquids being dispensed. It is also apparent that the pumping mechanisms in both patents are assembled to the reservoirs so as to form unitary and permanent dispensers. Thus, disassembly and cleaning of the pumping mechanisms and reservoirs is not practical.

U.S. Pat. Nos. 2,622,539 and 2,765,964 illustrate stationary devices for dispensing metered quantities of liquid soap contained in reservoirs located above the pumping mechanism. Each pumping mechanism includes a spring-biased piston and a check valve arrangement for controlling the liquid flow. Both the pistons and the check valves are contained within a pump housing. The pumping mechanism is located outside of the reservoir, which is undesirable if the dispensing device must occupy a minimum amount of space. The soap is dispensed directly through openings formed in the pump housing. It is apparent that disassembly and cleaning of these two dispensers is a relatively difficult and time-consuming chore.

U.S. Pat. No. 4,105,146 shows another version of a stationary soap dispenser. The reservoir is located above the pumping mechanism. An intricately machined piston, together with two seals, are used in place of check valves to control the soap flow through the dispenser. The soap is ejected through an orifice which passes through both the pump housing and a surrounding housing formed integrally with the bottom of the reservoir. The configuration of the piston and other components limits application of this device to very viscous products. Although the pumping mechanism may be relatively easily disassembled, the intricacies of the piston passages renders this design very difficult to clean. The position of the pumping mechanism outside of the reservoir may be undesirable if a compact dispenser is required.

Thus, a need exists for pumping apparatus which is capable of dispensing relatively thin liquids and which may be quickly and easily disassembled for cleaning so that it can be used for consumable products.

SUMMARY OF THE INVENTION

In accordance with the present invention, a liquid dispenser is provided which is adapted to be readily disassembled for cleaning all surfaces of the dispenser components. This is accomplished by apparatus which includes a pumping mechanism and an upright reservoir containing the liquid to be dispensed. The pumping mechanism is detachably fixed to the reservoir by a single fastener that is quickly and easily removable. To further facilitate disassembly and cleaning, the pumping mechanism is composed of two interlocking but freely separable housings. The first, or pump, housing contains a metering device for consistently dispensing a predetermined and accurate volume of liquid. The second, or valve, housing contains a valve arrangement which properly directs the liquid from the reservoir to the outlet spout. The spout is formed as an integral part of the valve housing.

The present invention also provides for the liquid dispensing unit to occupy a minimum of space. For that purpose, the pumping mechanism, including both the pump housing and the valve housing, is located inside the reservoir and thus immersed in the liquid being dispensed. Since the valve housing incorporates the outlet spout, the spout protrudes through the reservoir wall. In one embodiment of the invention, the reservoir is constructed with an overhanging upper section, and the outlet spout projects downwardly through the lower horizontal floor of the overhang. The spout and overhang are located a distance above the bottom of the reservoir to suit the application at hand.

Other objects, features, and advantages of the invention will become apparent to those skilled in the art from the disclosure.

DETAILED DESCRIPTION OF THE PREFERRED EMBODIMENT

Figure 1:
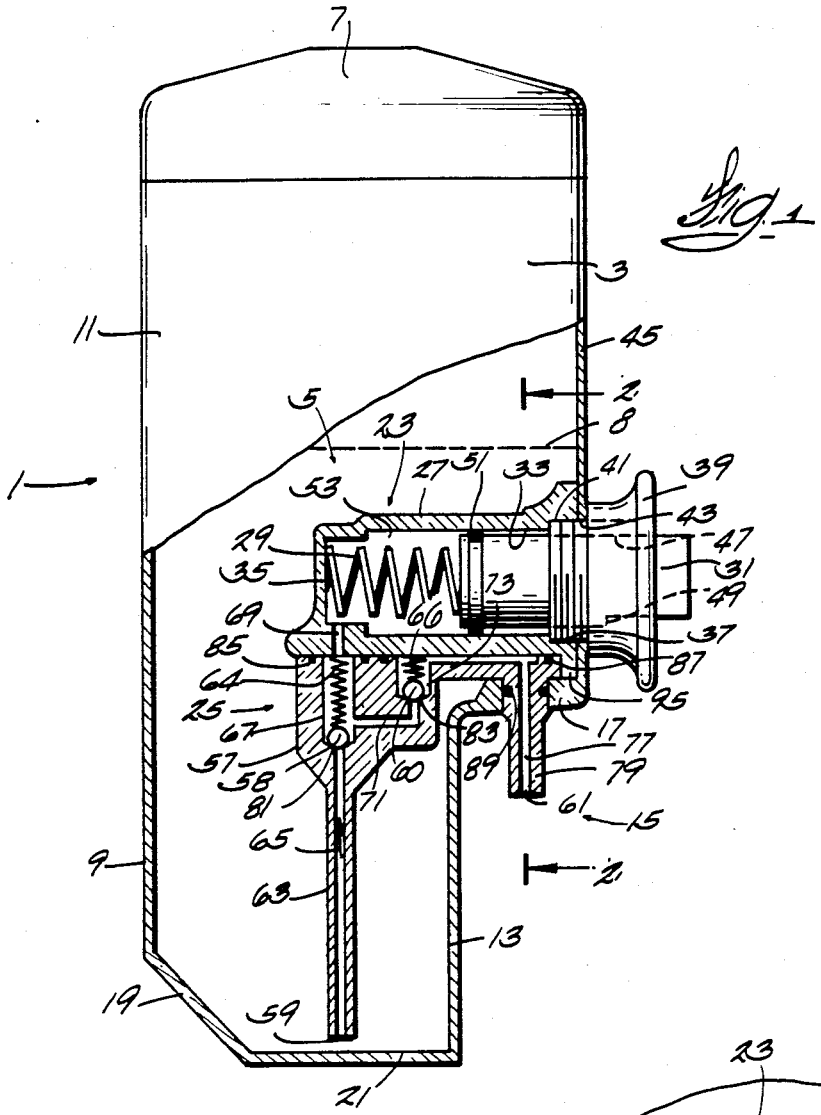
FIG. 1 is a side view, partially in section, of the decanter and pump assembly of the present invention.

Referring to FIG. 1, reference numeral 1 indicates the decanter and pump assembly of the present invention. The preferred embodiment of this invention finds particular usefulness for dispensing flavored syrups over crushed ice in a cup-like container to create a well known refreshment. However, while the invention will be described in connection with a preferred embodiment and application, it will be understood that it is not intended to limit the invention to that embodiment or application. On the contrary, it is intended to cover all alternatives, modifications, and equivalents as may be included within the spirit and broad scope of the invention as defined by the appended claims.

In the illustrated embodiment, the decanter and pump assembly consists of an upright reservoir 3 and a pumping mechanism 5. The reservoir, which is open at the top and covered with a cover 7, is filled with liquid flavor or other fluid 8. The reservoir is preferably composed of a lower section 9 and an upper section 11. Upper section 11 overhangs front wall 13 of the lower section 9, thus creating a space 15 below floor 17 of the upper section. The function of the space 15 will be fully explained hereinafter. The lower section may be fabricated with a chamber 19 at the junction of the reservoir floor 21 and the wall opposite front wall 13.

In accordance with the present invention, the pumping mechanism 5 includes a metering device 23 which supports and interlocks with valve arrangement 25, as will be explained. In the illustrated embodiment, the metering device 23 consists of a pump housing 27, a spring 29, and a piston 31. The pump housing 27 is constructed with a generally cylindrical internal cavity 33 which is bounded at the back end by wall 35. The front end of the pump housing is preferably formed with internal threads 37. To firmly attach the pump housing to the reservoir 3, a hollow nut 39 with external threads 41 extends through an opening 43 in front wall 45 to engage threads 37. Piston 31 slides freely within and is guided by bore 47 of the nut 39. Spring 29, reacting against wall 35, biases the piston in the outward direction, that is, to the right with respect to FIG. 1. Outward motion of the piston is limited by shoulder 49 of the piston contacting a corresponding shoulder formed at an enlargement of bore 47. An O-ring 51 is utilized in conjunction with the piston to create a sealed portion 53 of chamber 33. A similar O-ring may be employed in conjunction with the pump housing to seal the liquid 8 against leaking out opening 43.

Further in accordance with this invention, the pumping mechanism 5 includes a valve arrangement 25. In the present instance, the valve arrangement consists of a valve housing 57 together with check balls 58, 60, and springs 64, 66. The valve housing preferably is supported by and is attached to the pump housing 27 without fasteners, as will be explained. The valve housing is fabricated with a series of interconnected passages leading from a liquid inlet 59 to a liquid outlet 61. The liquid inlet 59 may be located at the end of an inlet tube 63 formed as a part of the valve body and extending to within a short distance of floor 21. Passage 65 extends from inlet 59 to sealed chamber 53 via chamber 67 in the valve housing and passage 69 in the pump housing 27. The valve housing also contains a right angle passage 71 which connects chamber 67 with a similar chamber 73. Chamber 73 is connected by another passage 75 formed in the valve housing to passage 77, which leads to the liquid outlet 61. Passage 77 is located within an outlet tube 79, which is formed integrally with the valve housing and which protrudes through the floor 17 of the reservoir upper section 11. The outlet tube terminates within the space 15. The space allows a suitable container to be positioned beneath the outlet tube to catch the dispensed liquid.

To direct the liquid 8 from the reservoir 3 to the outlet 61, a ball and spring combination is employed in conjunction with each chamber 67, 73. Chambers 67 and 73 are formed with conical seats 81, 83, respectively, which mate with balls 58, 60, respectively. Spring 64, which is inserted in chamber 67, has a lower spring rate than spring 66. For example, spring 64 may have a spring rate of approximately 0.10 lbs. per inch, and spring 66 may have a spring rate of about 0.34 lbs. per inch. To seal the interconnecting passages at the junctions between the valve housing and the pump housing, O-ring seals 85 and 87 may be utilized. A similar O-ring 89 may be used to seal the liquid 8 inside the reservoir 3 against leakage past outlet tube 79 where it protrudes through floor 17.

Figure 2:
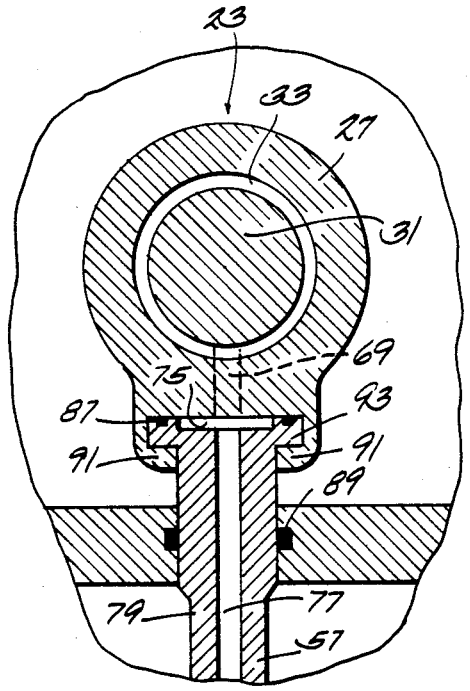
FIG. 2 is a sectional view taken along lines 2—2 of FIG. 1.

Because the decanter and pump of the present invention may be used to handle food products, the invention is also concerned with sanitation. For example, the "National Sanitation Foundation" code requires that check balls and springs be removable for cleaning. For the purpose of rapid and efficient disassembly and cleaning, the valve housing 57 and the pump housing 27 are assembled without fasteners. As shown in FIG. 2, the lower portion of the pump housing is formed with a pair of allochiral flanges 91 which form a T-slot. The upper portion of the valve housing is formed as a tee 93 which interfits with the T-slot of the pump housing. The tee of the valve housing is inserted into the T-slot of the pump housing from the left with respect to FIG. 1. The pump housing is constructed with a downwardly projecting lip 95, FIG. 1, which limits the entry of the valve housing into the pump housing. The T-slot and tee are formed with very slight tapers so that the valve housing tee is slightly wedged into the pump housing T-slot at the point of maximum insertion. In this manner, the valve housing is joined to and is supported by the pump housing in a secure yet easily detachable manner that does not require any fasteners. Thus, the pumping mechanism 5, including the balls 58, 60 and springs 64, 66 may be completely disassembled for cleaning merely by unscrewing nut 39 from the pump housing and by removing the tee of the valve housing from the T-slot of the pump housing.

To further enhance sanitation, particular care is exercised with regard to the materials used in the decanter and pump assembly components. A satisfactory material for the structural components is marketed under the specification Mitsui Chemical TPX-(rt 18). The springs are stainless steel, and the check balls are a suitable rubber compound manufactured by Minnesota Rubber Company.

To assemble the decanter and pump assembly of this invention, the ball 58 and spring 64 are inserted into chamber 67, and ball 60 and spring 66 are inserted into chamber 73. O-ring seals 85, 87 and 89 are placed in their respective locations on the valve housing 57. The tee 93 of the valve housing is inserted into the T-slot formed by flanges 91 of the pump housing 27 until the tee strikes the lip 95. The slight tapers built into the tee and T-slot will cause the two housings to be firmly yet gently secured to each other. The seal 55 is positioned on the pump housing, and the two part assembly is inserted into the reservoir 3, such that the outlet tube 79 protrudes through the floor 17. O-ring 51 is assembled to piston 31. Spring 29 and then piston 31 are inserted into the cavity 33. Nut 39 is slipped over the piston, and the nut is screwed onto the threads 37 of the pump housing. Finally, the reservoir is filled with the desired liquid, and the cover attached. The decanter and pump assembly is now ready for operation.

To operate the decanter and pump assembly of this invention, an initial starting point as shown in FIG. 1 will be assumed. In that configuration, the spring 29 forces piston 31 to the extreme right against nut 39. In this position, sealed chamber 53 is filled with a maximum volume of the liquid. Spring 64 urges ball 58 against seat 81 to close off passage 65, and spring 66 urges ball 60 against seat 83. Passages 69 and 71 and chamber 67 are also filled with liquid. A suitable container for receiving the liquid to be dispensed is positioned within space 15 beneath outlet tube 79. The operator then pushes the piston to force the liquid out of sealed chamber 33 and through passage 69, chamber 67, and passage 71. The force of the liquid firmly seats ball 58 on seat 81, but the fluid will overcome spring 66 to unseat ball 60. Thus, the fluid will flow through passages 75 and 77 and into the container under outlet 61. When the piston is released, spring 29 will again urge it to the right with respect to FIG. 1. As the piston moves to the right, the liquid force on ball 60 is removed, but spring 66 will seat ball 60 onto seat 83. A vacuum is created in sealed chamber 53 as the piston moves to the right, causing atmospheric pressure above liquid 8 to force the liquid up passage 65. The spring 64, being relatively weak, is overcome by the liquid rising in passage 65 and allows the ball 58 to unseat. As a consequence, the fluid travels upward through chamber 67 and passage 69 to fill sealed chamber 53. The decanter and pump assembly is then ready for the next cycle.

Thus, it is apparent that there has been provided, in accordance with the invention, a decanter and pump assembly that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. A decanter and pump assembly for dispensing quantities of liquid comprising:

a. an open reservoir for holding the liquid;

b. a cover for covering the reservoir;

c. a metering device removably mountable to the interior of the reservoir and operable from outside the reservoir for pumping a predetermined quantity of liquid from the reservoir;

d. a valve arrangement detachably attached to the reservoir and the metering device in operable relationship thereto for controlling the flow of the liquid from inside the reservoir to outside the reservoir; and e. a fastener extending through a first opening in the reservoir and fastenable from outside the reservoir to engage the metering device and to provide the sole means for locking the metering device to the interior of the reservoir, the fastener having a longitudinal bore extending therethrough, so that upon unfastening the fastener from the metering device completely unlocks the metering device and valve arrangement from the reservoir.

2. The decanter and pump assembly of claim 1 wherein the reservoir is formed with an upper section and a lower section having at least one wall, the upper section having a floor terminating in a front wall, the upper section floor and front wall overhanging without obstruction at least said one wall of the lower section to create a space under the floor and external of the lower section wall, and wherein the fastener extends through the front wall of the reservoir upper section to removably mount the metering device to the reservoir.

3. An easily cleanable decanter and pump assembly for dispensing a predetermined amount of liquid comprising:

a. a covered upright reservoir for holding the liquid and having first and second openings therein;

b. a pump housing immersed in the liquid within the reservoir, the pump housing having an internal cavity with a passage leading therefrom and having a threaded portion;

c. a threaded fastener extending through the reservoir first opening and engaging the threaded portion of the pump housing, the fastener being adapted to cooperate with the pump housing to sandwich the reservoir between the pump housing and fastener for providing the sole means for locking the pump housing to the reservoir;

d. a piston slideable within the fastener and pump housing internal cavity to create a sealed chamber of predetermined volume within the internal cavity;

e. biasing means operatively associated with the pump housing and piston to bias the piston in one direction;

f. a valve housing detachable and operatively attached to the pump housing, the valve housing being formed with inlet and outlet tubes and interconnected passages joining the inlet and outlet tubes and the passage in the pump housing, the outlet tube protruding through the reservoir second opening; and g. control means interposed within the valve housing passages, so that operating the piston will dispense a predetermined quantity of liquid from the outlet tube.

4. A decanter and pump assembly for dispensing quantities of liquid comprising:

a. an open reservoir for holding the liquid, the reservoir being formed with an upper section and a lower section, the upper section having a floor and a front wall overhanging at least one wall of the lower section to create a space under the floor and external of the lower section wall, the reservoir having first and second openings therein, the second opening being formed in the floor of the reservoir upper section;

b. a cover for covering the reservoir;

c. a metering device operable from outside the reservoir for pumping a predetermined quantity of liquid from the reservoir, the metering device being mounted to the interior of the front wall of the reservoir upper section, the metering device comprising:

i. a pump housing having an internal cavity with a fluid passage leading therefrom;

ii. a piston slideably mounted for axial reciprocation within the pump housing cavity, one end of the piston extending outside the reservoir upper section through the first opening therein, the second end of the piston cooperating with the internal cavity to form a sealed chamber of predetermined volume; and iii. a spring disposed within the pump housing cavity to bias the piston in one direction;

d. a valve arrangement detachably attached to the metering device in operable relation thereto for controlling the flow of the liquid from inside the reservoir to outside the reservoir, the valve arrangement comprising:

i. a valve housing having a liquid inlet, a liquid outlet tube extending downwardly through the reservoir second opening and into the space created under the upper section floor and external of the lower section wall, and a plurality of interconnecting passages for transporting the liquid from the inlet to the outlet, at least one of the passages joining the fluid passage in the pump housing;

ii. at least two check valves interposed in the passages; and iii. a spring associated with each check ball; and e. a fastener for mounting the metering device to the interior of the reservoir.

5. A decanter and pump assembly for dispensing quantities of liquid comprising:

a. an open reservoir for holding liquid;

b. a cover for covering the reservoir;

c. a metering device operable from outside the reservoir for pumping a predetermined quantity of liquid from the reservoir, the metering device being formed with a pair of allochiral flanges forming a T-slot;

d. a valve arrangement detachable attached to the metering device in operable relation thereto for controlling the flow of the liquid from inside the reservoir to outside the reservoir, the valve arrangement being formed with a T-shaped portion for engaging the T-slot of the metering device, so that the metering device and the valve arrangement may be assembled without fasteners; and e. a fastener for mounting the metering device to the interior of the reservoir.

6. The decanter and pump assembly of claim 5 wherein the T-shaped portion of the T-slot are formed with slight tapers to firmly but gently wedge the metering device and valve arrangement together when in an assembled mode.

7. The decanter and pump assembly of claim 5 wherein the metering device is formed with a lip to limit the insertion of the T-shaped portion of the valve arrangement into the T-slot of the metering device.

8. An easily cleanable decanter and pump assembly for dispensing a predetermined amount of liquid comprising:

a. a covered upright reservoir for holding the liquid and having first and second openings therein, the reservoir being formed with an upper section and a lower section, the lower section having a front wall, and the upper section having a front wall having first reservoir openings therein and a floor having a second reservoir opening therein, the upper section front wall and floor overhanging the lower section front wall to create a space under the upper section floor and external of the lower section front wall;

b. a pump housing immersed in the liquid within the reservoir, the pump housing having an internal cavity with a passage leading therefrom;

c. a fastener extending through the reservoir first opening for fastening the pump housing to the interior of the reservoir;

d. a piston slideable within the fastener and internal cavity to create a sealed chamber of predetermined volume within the internal cavity;

e. biasing means operatively associated with the pump housing and piston to bias the piston in one direction;

f. a valve housing detachable and operatively attached to the pump housing, the valve housing being formed with inlet and outlet tubes and interconnected passages joining the inlet and outlet tubes and the passage in the pump housing, the outlet tube protruding downwardly through the reservoir second opening in the upper section floor and into the space under the upper section floor and external of the lower section front wall; and g. control passages interposed within the valve housing passages, so that operating the piston will dispense a predetermined quantity of liquid from the outlet tube.

9. The decanter and pump assembly of claim 8 wherein the pump housing is formed with a T-slot, and wherein the valve housing is formed with a T-section, and wherein the valve housing is attached to the pump housing by sliding the T-section into the T-slot.

10. The decanter and pump assembly of claim 9 wherein the pump housing is formed with threads, and wherein the fastener is a nut having corresponding threads to engage the pump housing threads through the reservoir first opening;

so that the pump assembly may be first disassembled from the decanter by unscrewing the nut from the pump housing and the valve housing may be disassembled from the pump housing by sliding the T-section of the valve housing out of the T-slot of the pump housing, respectively.

* * * * *